US007451872B1

(12) United States Patent
Allen

(10) Patent No.: US 7,451,872 B1
(45) Date of Patent: Nov. 18, 2008

(54) WEAPONRY CONTAINER HAVING A RIGID OUTER SURFACE

(75) Inventor: Richard E. Allen, Colleyville, TX (US)

(73) Assignee: Boyt Harness Company, LLC, Osceola, IA (US)

( * ) Notice: Subject to any disclaimer, the term of this patent is extended or adjusted under 35 U.S.C. 154(b) by 43 days.

(21) Appl. No.: 11/460,506

(22) Filed: Jul. 27, 2006

(51) Int. Cl.
*B65D 85/00* (2006.01)

(52) U.S. Cl. ..... 206/315.11; 206/317; 190/117

(58) Field of Classification Search ..... 206/315.1, 206/315.11, 317, 372, 373, 521, 594; 190/117, 190/119, 903
See application file for complete search history.

(56) References Cited

U.S. PATENT DOCUMENTS 2,335,950 A * 12/1943 Lynam ..... 190/119
2,499,497 A 3/1950 Gross
3,369,721 A 2/1968 Lentz
3,387,698 A 6/1968 Hendricks et al.
3,391,765 A * 7/1968 Baker ..... 190/117
3,437,247 A 4/1969 Hardigg
3,441,125 A 4/1969 Small
3,445,553 A 5/1969 Hardigg
3,540,508 A 11/1970 Couch
3,570,703 A 3/1971 MacRae
3,612,233 A * 10/1971 Nagpal et al. ..... 190/117
3,669,336 A 6/1972 Robinson
3,690,540 A 9/1972 Hardigg
3,701,371 A 10/1972 Stackhouse
3,731,818 A 5/1973 Young
3,744,687 A 7/1973 Oreck
3,780,487 A 12/1973 Munson
3,811,562 A 5/1974 Smith
3,865,166 A 2/1975 Pedro
3,896,987 A 7/1975 Soja
3,907,108 A 9/1975 Weimer, Jr.
3,944,033 A * 3/1976 Simson ..... 190/117
3,993,507 A 11/1976 Hardigg
4,066,401 A 1/1978 Solomon
4,074,380 A 2/1978 Parker
4,118,265 A 10/1978 Hardigg
4,119,199 A 10/1978 Whitaker, Jr.
4,162,004 A 7/1979 Thomas
4,180,232 A 12/1979 Hardigg
4,257,464 A 3/1981 Binney (Continued)

FOREIGN PATENT DOCUMENTS

CA 962974 2/1975

(Continued)

OTHER PUBLICATIONS

Hardigg Industries, Inc. Products, Figs. 1A-1D [online]. Retrieved from the Internet in Apr. 19, 2006.

(Continued)

*Primary Examiner*—Jacob K Ackun, Jr.
(74) *Attorney, Agent, or Firm*—Bell, Boyd & Lloyd LLP

(57) ABSTRACT

A weaponry container that is operable to hold a weapon. The weaponry container includes a plurality of panels which include an outer surface that is substantially rigid or firm. The panels are operable to be placed in a closed position by an elongated fastener.

26 Claims, 13 Drawing Sheets

U.S. PATENT DOCUMENTS

| | | | | |
|---|---|---|---|---|
| 4,276,360 | A | 6/1981 | Hardigg et al. | |
| 4,284,202 | A | 8/1981 | Barstow, Jr. | |
| D264,002 | S | 4/1982 | Hardigg | |
| 4,331,748 | A | 5/1982 | Hardigg et al. | |
| 4,336,883 | A * | 6/1982 | Krug et al. | 206/545 |
| 4,337,024 | A | 6/1982 | Turner et al. | |
| 4,349,105 | A | 9/1982 | Bradley et al. | |
| 4,352,977 | A | 10/1982 | Hardigg et al. | |
| 4,380,577 | A | 4/1983 | Hardigg | |
| 4,390,384 | A | 6/1983 | Turner | |
| 4,419,321 | A | 12/1983 | Hardigg | |
| 4,439,263 | A | 3/1984 | Hardigg et al. | |
| 4,446,900 | A | 5/1984 | Markovich | |
| 4,463,847 | A | 8/1984 | Gordon | |
| 4,475,247 | A | 10/1984 | Lee | |
| 4,489,833 | A | 12/1984 | Bauer | |
| 4,495,260 | A | 1/1985 | Hardigg et al. | |
| D278,189 | S | 4/1985 | Frydenberg | |
| 4,530,178 | A | 7/1985 | Rauscher | |
| 4,531,639 | A | 7/1985 | Zopf | |
| 4,548,392 | A | 10/1985 | Rickling | |
| 4,553,464 | A | 11/1985 | Turner et al. | |
| 4,680,682 | A | 7/1987 | Parker | |
| 4,702,029 | A | 10/1987 | DeVaul et al. | |
| 4,721,205 | A | 1/1988 | Burt et al. | |
| 4,732,826 | A | 3/1988 | Hardigg | |
| 4,741,972 | A | 5/1988 | Hardigg | |
| 4,756,456 | A | 7/1988 | Schauer | |
| 4,757,665 | A | 7/1988 | Hardigg | |
| RE32,752 | E | 9/1988 | Kiang | |
| 4,788,838 | A | 12/1988 | Cislo | |
| 4,858,361 | A | 8/1989 | White | |
| 4,860,479 | A | 8/1989 | Easter | |
| D303,846 | S | 10/1989 | Parker | |
| 4,871,628 | A | 10/1989 | Parker | |
| 4,890,466 | A | 1/1990 | Cislo | |
| 4,998,636 | A | 3/1991 | Hardigg | |
| 5,012,553 | A | 5/1991 | Hardigg et al. | |
| 5,027,967 | A | 7/1991 | Tellas | |
| D320,113 | S | 9/1991 | VanSkiver | |
| 5,048,682 | A | 9/1991 | Taylor | |
| 5,071,444 | A | 12/1991 | Gaydos | |
| 5,118,175 | A | 6/1992 | Costello | |
| D327,646 | S | 7/1992 | Hardigg et al. | |
| 5,161,396 | A | 11/1992 | Loeff | |
| 5,168,994 | A | 12/1992 | Beletsky et al. | |
| 5,172,575 | A | 12/1992 | Fisher | |
| 5,203,449 | A | 4/1993 | Bonardi | |
| 5,236,086 | A | 8/1993 | MacTaggart | |
| 5,296,075 | A | 3/1994 | Hardigg et al. | |
| D345,845 | S | 4/1994 | Strzegowski, Jr. | |
| 5,299,722 | A | 4/1994 | Cheney | |
| D347,322 | S | 5/1994 | Fiore | |
| D350,618 | S | 9/1994 | Parker | |
| 5,344,010 | A | 9/1994 | Dyer et al. | |
| 5,349,507 | A | 9/1994 | Parker | |
| 5,349,512 | A | 9/1994 | Parker | |
| 5,370,254 | A | 12/1994 | Hardigg et al. | |
| 5,375,440 | A | 12/1994 | Patterson | |
| D356,676 | S | 3/1995 | Sanderson | |
| 5,394,966 | A * | 3/1995 | Chow | 190/119 |
| D357,117 | S | 4/1995 | Huang | |
| D357,180 | S | 4/1995 | Stover | |
| 5,404,281 | A | 4/1995 | Parker | |
| 5,410,457 | A | 4/1995 | Parker | |
| 5,416,284 | A | 5/1995 | Steele et al. | |
| 5,431,970 | A | 7/1995 | Brown et al. | |
| D360,757 | S | 8/1995 | Snetting et al. | |
| D362,805 | S | 10/1995 | Hardigg | |
| 5,458,266 | A | 10/1995 | Pichot | |
| 5,461,755 | A | 10/1995 | Hardigg et al. | |
| 5,466,316 | A | 11/1995 | Hardigg et al. | |
| 5,488,799 | A | 2/1996 | Hauschild | |
| 5,505,355 | A | 4/1996 | Williams | |
| 5,551,562 | A | 9/1996 | Beretta | |
| D376,474 | S | 12/1996 | Marks | |
| 5,584,424 | A | 12/1996 | Stava | |
| 5,606,820 | A * | 3/1997 | Suddeth | 43/57.1 |
| 5,619,819 | A | 4/1997 | Hauschild | |
| D383,558 | S | 9/1997 | Parker | |
| 5,662,219 | A | 9/1997 | Tschudy et al. | |
| 5,662,220 | A | 9/1997 | Schurman | |
| 5,669,495 | A | 9/1997 | West | |
| 5,671,830 | A | 9/1997 | Wood | |
| D385,108 | S | 10/1997 | Tschudy | |
| 5,678,344 | A | 10/1997 | Jones et al. | |
| 5,678,686 | A | 10/1997 | Hagemann et al. | |
| 5,683,021 | A | 11/1997 | Setina | |
| 5,736,221 | A | 4/1998 | Hardigg et al. | |
| D396,345 | S | 7/1998 | Sanderson | |
| 5,779,031 | A | 7/1998 | Moraine et al. | |
| D398,149 | S | 9/1998 | Sanderson et al. | |
| 5,806,673 | A | 9/1998 | Sanderson | |
| 5,810,064 | A | 9/1998 | Sanderson et al. | |
| 5,829,586 | A | 11/1998 | Mermell | |
| D402,068 | S | 12/1998 | Parker | |
| D402,462 | S | 12/1998 | Sanderson | |
| 5,873,480 | A | 2/1999 | Wells, Jr. | |
| 5,881,874 | A | 3/1999 | McKinney | |
| 5,924,565 | A | 7/1999 | Colee | |
| 5,927,361 | A | 7/1999 | Sanderson et al. | |
| 5,996,180 | A * | 12/1999 | Eisenzopf | 16/406 |
| 6,009,654 | A | 1/2000 | Williams et al. | |
| 6,009,996 | A | 1/2000 | Purdy | |
| 6,135,277 | A | 10/2000 | Armstrong | |
| 6,145,719 | A | 11/2000 | Robert | |
| 6,158,745 | A | 12/2000 | Deighton | |
| D436,417 | S | 1/2001 | Parker | |
| D437,065 | S | 1/2001 | Parker | |
| 6,179,438 | B1 | 1/2001 | Parker | |
| 6,183,105 | B1 | 2/2001 | Parker | |
| 6,186,641 | B1 | 2/2001 | Parker | |
| D439,048 | S | 3/2001 | Sanderson | |
| D439,407 | S | 3/2001 | Parker | |
| D439,690 | S | 3/2001 | Parker | |
| 6,203,075 | B1 | 3/2001 | Wells, Jr. et al. | |
| 6,210,829 | B1 | 4/2001 | Hardigg | |
| D441,954 | S | 5/2001 | Parker | |
| D442,307 | S | 5/2001 | Parker | |
| 6,224,235 | B1 | 5/2001 | Parker | |
| 6,230,925 | B1 | 5/2001 | Hardigg et al. | |
| 6,244,432 | B1 | 6/2001 | Saari et al. | |
| D445,925 | S | 7/2001 | Parker | |
| 6,253,915 | B1 | 7/2001 | Mesica et al. | |
| 6,260,300 | B1 | 7/2001 | Klebes et al. | |
| 6,263,510 | B1 * | 7/2001 | Bay et al. | 2/93 |
| D446,184 | S | 8/2001 | Parker | |
| D446,936 | S | 8/2001 | Sanderson et al. | |
| D448,565 | S | 10/2001 | Sanderson | |
| D449,394 | S | 10/2001 | Parker | |
| D451,223 | S | 11/2001 | Parker | |
| 6,332,997 | B1 | 12/2001 | Hardigg et al. | |
| RE37,518 | E | 1/2002 | Hardigg et al. | |
| 6,345,709 | B1 * | 2/2002 | Cheng | 190/119 |
| 6,350,040 | B1 | 2/2002 | Parker | |
| 6,367,603 | B1 * | 4/2002 | Tiramani et al. | 190/100 |
| D456,921 | S | 5/2002 | Parker et al. | |
| D456,922 | S | 5/2002 | Parker et al. | |
| D462,472 | S | 9/2002 | Parker et al. | |
| D462,519 | S | 9/2002 | Gaydos et al. | |
| D464,196 | S | 10/2002 | Parker | |
| D465,330 | S | 11/2002 | Parker | |
| D467,424 | S | 12/2002 | Hardigg et al. | |
| D467,425 | S | 12/2002 | Hardigg et al. | |

D467,426 S 12/2002 Hardigg et al.
6,488,148 B1 12/2002 Woodson
D471,355 S 3/2003 Sanderson et al.
6,527,309 B1 3/2003 Gaydos et al.
6,536,912 B2 3/2003 Parker
D472,384 S 4/2003 Richardson
D473,009 S 4/2003 Jarrett
6,547,070 B1 4/2003 Kolpin
6,557,702 B1 5/2003 Sanderson et al.
6,570,501 B2 5/2003 Bushnell et al.
D477,141 S 7/2003 Gantert
6,601,680 B2 8/2003 Japchen
D479,398 S 9/2003 Sanderson
6,612,412 B2 9/2003 Sanderson et al.
6,622,881 B2 9/2003 Hardigg
6,626,339 B2 9/2003 Gates et al.
D482,529 S 11/2003 Hardigg et al.
6,646,864 B2 11/2003 Richardson
D483,948 S 12/2003 Parker
D484,304 S 12/2003 Sanderson
6,659,495 B1 12/2003 Sanderson
6,662,944 B2 12/2003 Hagemann et al.
D485,069 S 1/2004 Parker
D485,626 S 1/2004 Parker
6,698,608 B2 3/2004 Parker et al.
6,722,496 B2 * 4/2004 Gantert ..... 206/315.11
6,729,489 B2 5/2004 Sanderson
D491,724 S 6/2004 Sanderson
D492,184 S 6/2004 Parker et al.
6,752,514 B2 6/2004 Parker
6,829,917 B2 12/2004 Russell
D500,875 S 1/2005 Parker et al.
6,843,081 B1 1/2005 Painter
6,845,640 B2 1/2005 Loeff et al.
6,874,628 B2 4/2005 Hammill
6,902,087 B2 * 6/2005 Hancock et al. ..... 224/401
6,909,260 B2 6/2005 Parker
6,953,126 B2 10/2005 Parker et al.
6,955,381 B2 10/2005 Parker et al.
D513,084 S 12/2005 Parker et al.
D513,123 S 12/2005 Richardson et al.
D513,451 S 1/2006 Richardson et al.
D514,808 S 2/2006 Morine et al.
6,995,976 B2 2/2006 Richardson
D516,309 S 3/2006 Richardson et al.
D516,553 S 3/2006 Richardson et al.
D516,554 S 3/2006 Richardson et al.
D516,807 S 3/2006 Richardson et al.
7,048,103 B2 * 5/2006 Hollingsworth ..... 190/117
2001/0052711 A1 12/2001 Bingman
2002/0064041 A1 5/2002 Parker
2002/0149930 A1 10/2002 Parker
2002/0190066 A1 12/2002 Hardigg
2003/0035286 A1 2/2003 Parker
2003/0052124 A1 3/2003 Gaydos
2003/0057122 A1 3/2003 Bushnell et al.
2003/0080124 A1 5/2003 Parker
2003/0085140 A1 5/2003 Hagemann et al.
2003/0106819 A1 6/2003 Bennett
2003/0111370 A1 6/2003 Sanderson et al.
2003/0121741 A1 7/2003 Japchen
2003/0159954 A1 8/2003 Russell
2003/0201198 A1 10/2003 Gantert
2003/0222082 A1 12/2003 Sanderson
2004/0079660 A1 4/2004 Sauey et al.
2004/0083778 A1 5/2004 Loeff et al.
2004/0099497 A1 5/2004 Parker et al.
2004/0104136 A1 6/2004 Schonenbach
2004/0104137 A1 6/2004 Schonenbach
2004/0139528 A1 * 7/2004 Hord ..... 2/96
2004/0144664 A1 7/2004 Hammill
2004/0149605 A1 8/2004 Ohtaki et al.
2004/0173655 A1 9/2004 Markson
2004/0195125 A1 10/2004 Sanderson
2004/0195999 A1 10/2004 Parker
2004/0197648 A1 10/2004 Sciutto
2004/0226793 A1 11/2004 Tilby et al.
2005/0001435 A1 1/2005 Parker et al.
2005/0011786 A1 1/2005 Wood et al.
2005/0092632 A1 5/2005 Stanton et al.
2005/0123220 A1 6/2005 Smith
2005/0123830 A1 6/2005 Hardigg et al.
2005/0128738 A1 6/2005 Parker et al.
2005/0152134 A1 7/2005 Parker et al.
2005/0172681 A1 8/2005 Tonelli
2005/0184703 A1 8/2005 Parker
2005/0230395 A1 * 10/2005 Parker et al. ..... 220/23.87
2005/0254238 A1 11/2005 Parker et al.
2005/0257678 A1 11/2005 Camp
2006/0017293 A1 1/2006 Tonelli
2006/0026795 A1 2/2006 Tonelli
2006/0042897 A1 3/2006 Sanderson
2006/0054532 A1 3/2006 Ochi
2006/0060588 A1 3/2006 Tonelli
2006/0065560 A1 3/2006 Dickinson et al.
2006/0011641 A1 1/2007 Sanderson

FOREIGN PATENT DOCUMENTS

CA 1077132 5/1980
CA 1130071 8/1982
CA 1139912 1/1983
CA 1157086 11/1983
CA 1162253 2/1984
CA 1162606 2/1984
CA 2035439 1/1991
CA 2037274 10/1991
CA 2128663 5/1995
CA 2143565 8/1995
CA 2181669 1/1997
CA 2307662 7/1999
CA 2272481 11/1999
CA 2297952 12/1999
CA 2314708 1/2001
CA 2388249 12/2002
CA 2391058 3/2003
DE 69526071 11/2002
DE 10238155 11/2003
DE 10238157 11/2003
DE 69625286 11/2003
DE 20212808 1/2004
DE 20212810 1/2004
DE 202004010232 9/2004
DE 202005003382 6/2005
DE 19981898 7/2005
DE 69918370 7/2005
DE 202005004058 8/2005
DE 102005034405 3/2006
DE 102005043922 3/2006
EP 97410 1/1984
EP 611079 8/1994
EP 431147 5/1995
EP 654414 5/1995
EP 744854 11/1996
EP 754540 1/1997
EP 959014 11/1999
EP 1073129 1/2001
EP 999927 9/2002
EP 1238776 9/2002
EP 1389725 2/2004
EP 1389726 2/2004
EP 1541918 6/2005
ES 2104268 10/1997
ES 2172568 10/2002
ES 2183564 3/2003
FR 2577773 8/1986

| | | |
|---|---|---|
| IL | 119659 | 1/2001 |
| IT | 1187319 | 12/1987 |
| IT | 950092 | 1/1996 |
| IT | 990024 | 9/2000 |
| IT | 990025 | 9/2000 |
| IT | 990026 | 9/2000 |
| IT | 990105 | 9/2000 |
| IT | 990106 | 9/2000 |
| IT | 990107 | 9/2000 |
| IT | 990137 | 6/2001 |
| MX | 7503 | 5/1989 |
| WO | WO9010954 | 9/1990 |
| WO | WO9100221 | 1/1991 |
| WO | WO9100828 | 1/1991 |
| WO | WO9205077 | 4/1992 |
| WO | WO9846499 | 10/1998 |
| WO | WO9927381 | 6/1999 |
| WO | WO9936324 | 7/1999 |
| WO | WO9940385 | 8/1999 |
| WO | WO9961217 | 12/1999 |
| WO | WO0049359 | 8/2000 |
| WO | WO0065292 | 11/2000 |
| WO | WO2004044355 | 5/2004 |

OTHER PUBLICATIONS

Plican Products, Inc. Products, Figs. 2A-2E [online]. Retrieved from the Internet on Apr. 19, 2006.

SKB Corporation Products, Figs. 3A-3E [online]. Retrieved from the Internet on Apr. 19, 2006.

Otter Products LLC Prodcuts, Figs. 4A-4D [online]. Retrieved from the Internet on Apr. 19, 2006.

* cited by examiner

WEAPONRY CONTAINER HAVING A RIGID OUTER SURFACE

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Many people use cases to transport guns. Some gun cases are made of fabric. The user of fabric gun cases can cause the gun to be unintentionally fired or to be damaged by water or impact. There are also plastic gun cases with buckles. The buckles can be cumbersome to use and are known to fail, jam or break depending upon the operating conditions. Also, the fabric and plastic gun cases can, depending upon the conditions, enable liquid to leak into the cases. Therefore, there is a need to overcome these disadvantages, and there is also a need to improve the structure and functionality of weaponry containers.

SUMMARY

The present disclosure relates to a weaponry container or case that is operable to hold a weapon such as a rifle. In one embodiment, the weaponry container includes a plurality of panels or walls. Each of the panels includes an outer surface that is substantially rigid or firm. The interior of each of the panels includes a securing member, such as a cushion, to protect the weapon from shock and shifting. The interior of at least one of the panels includes one or more weapon holders. The panels are connected to each other by a coupler. Additionally, at least a portion of each panel is operable to be connected to a portion of the other panel by a fastener. The fastener enables the panels to be in an open position and a closed position. A lip covers a portion of the fastener. In the closed position, the weaponry container defines a rifle or weapon space operable to receive a weapon. The weaponry container or case includes a handle assembly.

Additional features and advantages are described herein, and will be apparent from, the following Detailed Description and the figures.

DETAILED DESCRIPTION

Figure 1:
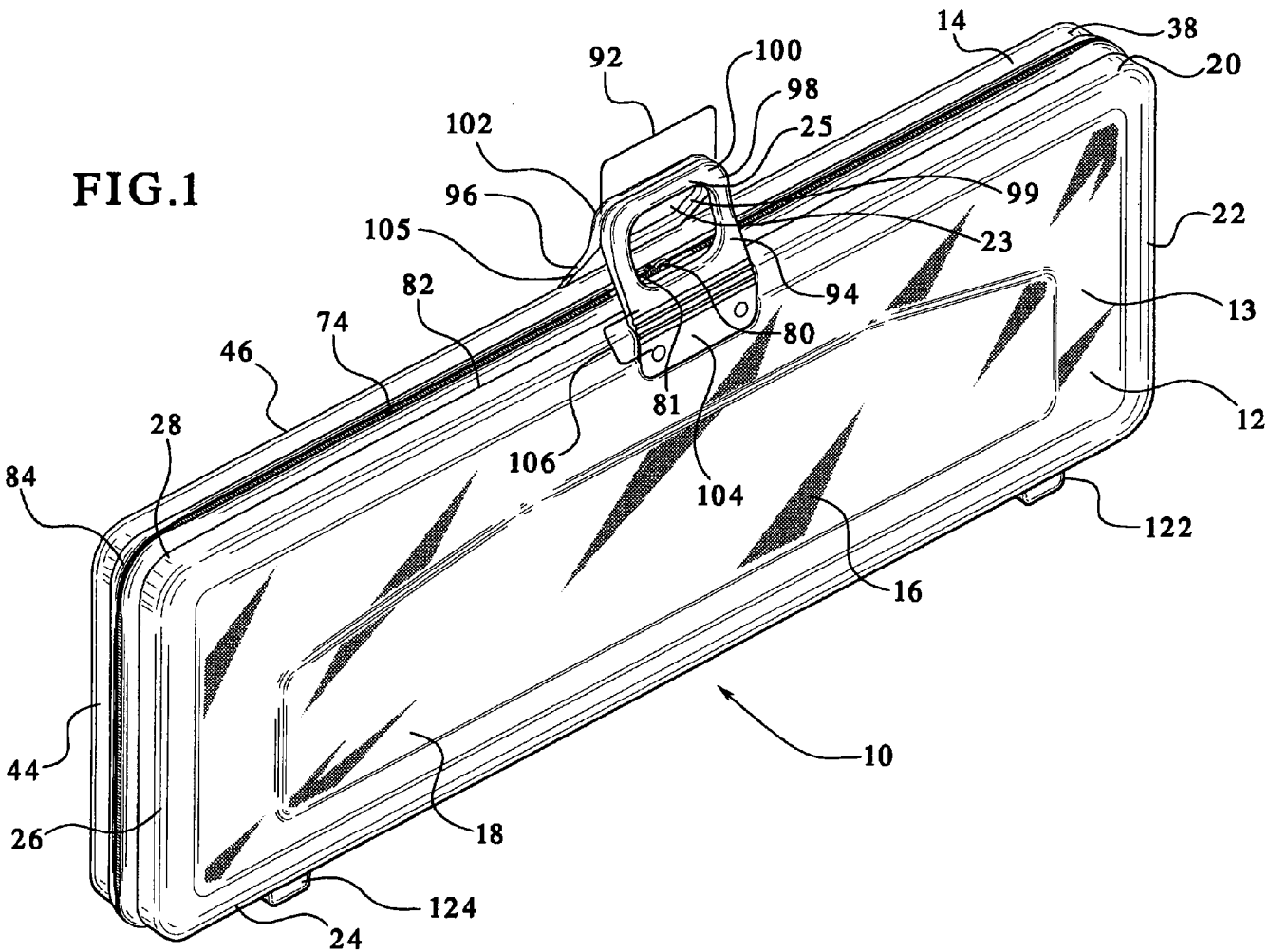
FIG. 1 is a front, top perspective view of one embodiment of the weaponry container.

In one embodiment, as illustrated in FIGS. 1 to 6 and 8 to 14, the weaponry case or container 10 includes: (a) a plurality of shells, walls or panels 12 and 14; (b) a coupler 72; (c) an elongated fastener 74 which enables the weaponry container 10 to be opened and closed; and (d) a handle assembly 92, all of which are described below.

The weaponry container 10 may be operable to hold or contain any suitable type of weapon, including, but not limited to, rifles, pistols, shotguns, handguns, military weapons, assault weapons, air pressured guns, bows, arrows, crossbows, paint ball guns and other weapon-related or gun-related devices.

1. Panels

The weaponry container 10 includes an upper wall or panel 12 and a lower wall or panel 14, as illustrated in FIGS. 1 to 6 and 8 to 14. These panels 12 and 14 may have any suitable size or shape to hold a weapon when in a closed position. As illustrated in FIG. 10, the panels 12 and 14 define a weapon space or a rifle space 11 when in a closed position. The panels 12 and 14 include an outer surface 13 that has a rigidity and strength to reduce the collapsibility of the weaponry container 10 when it is subject to the weight of a weapon or external forces. In one embodiment, each panel 12 and 14 is a stiff plastic shell fabricated through the molding of a vacuum formed plastic resin. In another embodiment, the outer surface 13 is made of a substantially high-strength, resilient synthetic polymer, such as polyethylene terephthalate (PET), coated by one or more layers of nylon, laminated nylon or any other suitable coating.

Figure 6:
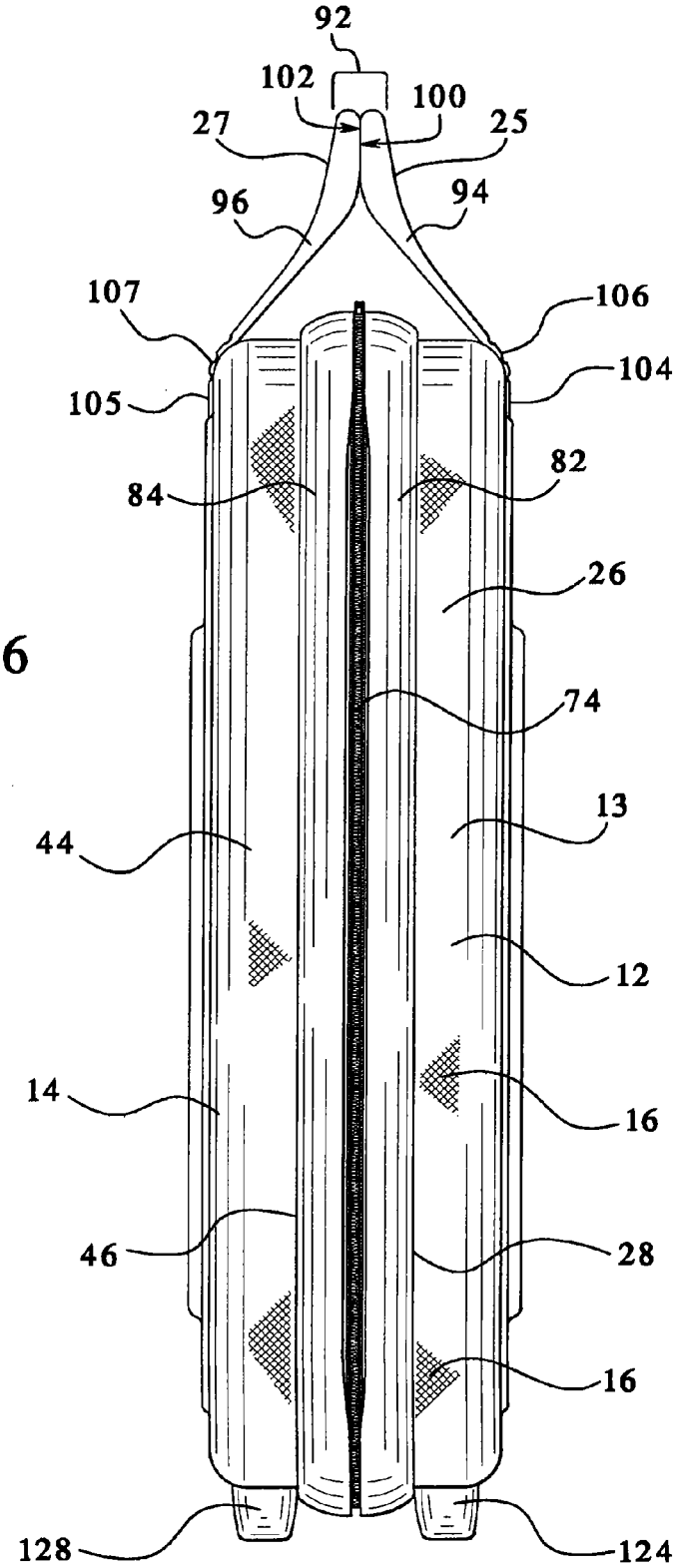
FIG. 6 is an elevated left end or side view of one embodiment of the weaponry container.
Figure 7:
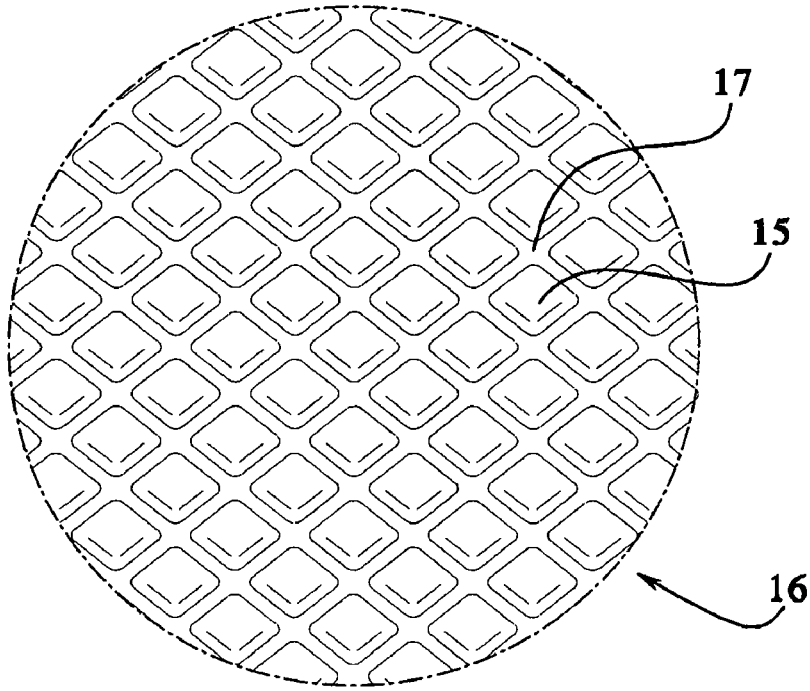
FIG. 7 is an enlarged view of a non-smooth surface of the exterior of one embodiment of the weaponry container.

In one embodiment, as illustrated in FIGS. 1 to 3, 6 and 7, the exterior or the outer surface 13 of the panels 10 and 12 includes or otherwise defines an irregular or non-smooth surface 16. As best illustrated in FIG. 7, in one embodiment, the irregular surface 16 includes a grid of raised partially rounded portions 15 defining a second grid of spaces or cavities 17. That is, the non-smooth surface 16 includes a plurality of raised members 15 which are spaced apart and aligned to define a textured or corrugated surface. In one embodiment, the non-smooth surface 16 is associated with a level of scratch resistance for the panels 12 and 14. That is, the raised portions 15 provide resistance against scratching of the panels 12 and 14. The raised portions 15 may be any shape, including, but not limited to, substantially round, substantially square, substantially diamond, substantially triangular or a plurality of different suitable shapes.

Figure 3:
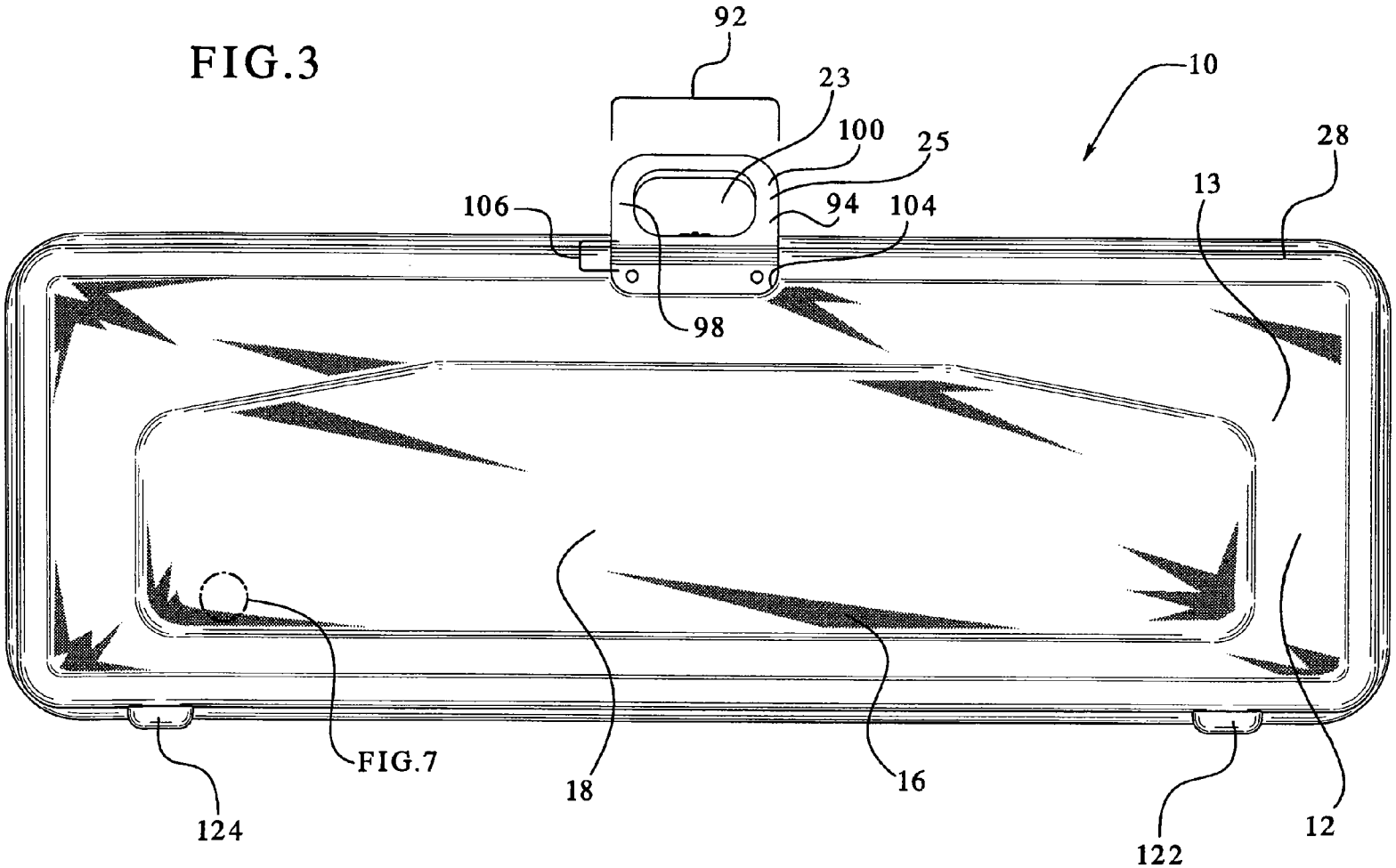
FIG. 3 is an elevated front view of one embodiment of the weaponry container.
Figure 4:
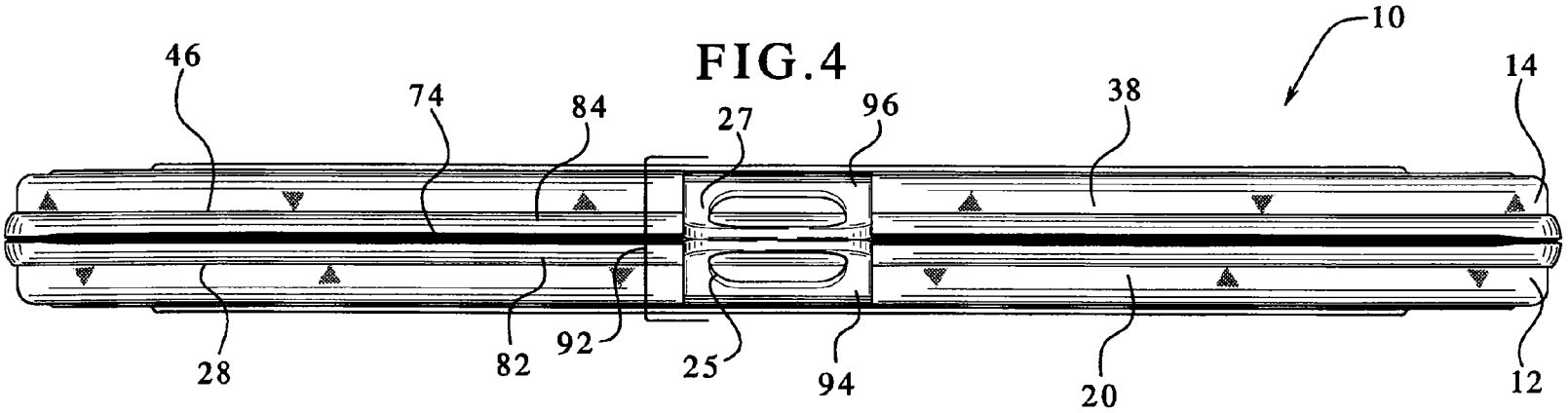
FIG. 4 is an elevated top view of one embodiment of the weaponry container.

As illustrated in FIGS. 1 and 3, the upper panel 12 includes a body 18. The body 18 may be any suitable shape. In one embodiment, the upper panel 12 includes a plurality of sidewalls, side portions or retaining walls 20, 22, 24 and 26 extending from the body 18. In one embodiment, the sidewalls 20, 22, 24 and 26 are substantially perpendicular to the body 18. It should be appreciated that the upper panel 12 may include any suitable configurations of portions, sidewalls or sections 20, 22, 24 and 26 that are operable to enclose one or more weapons.

Figure 2:
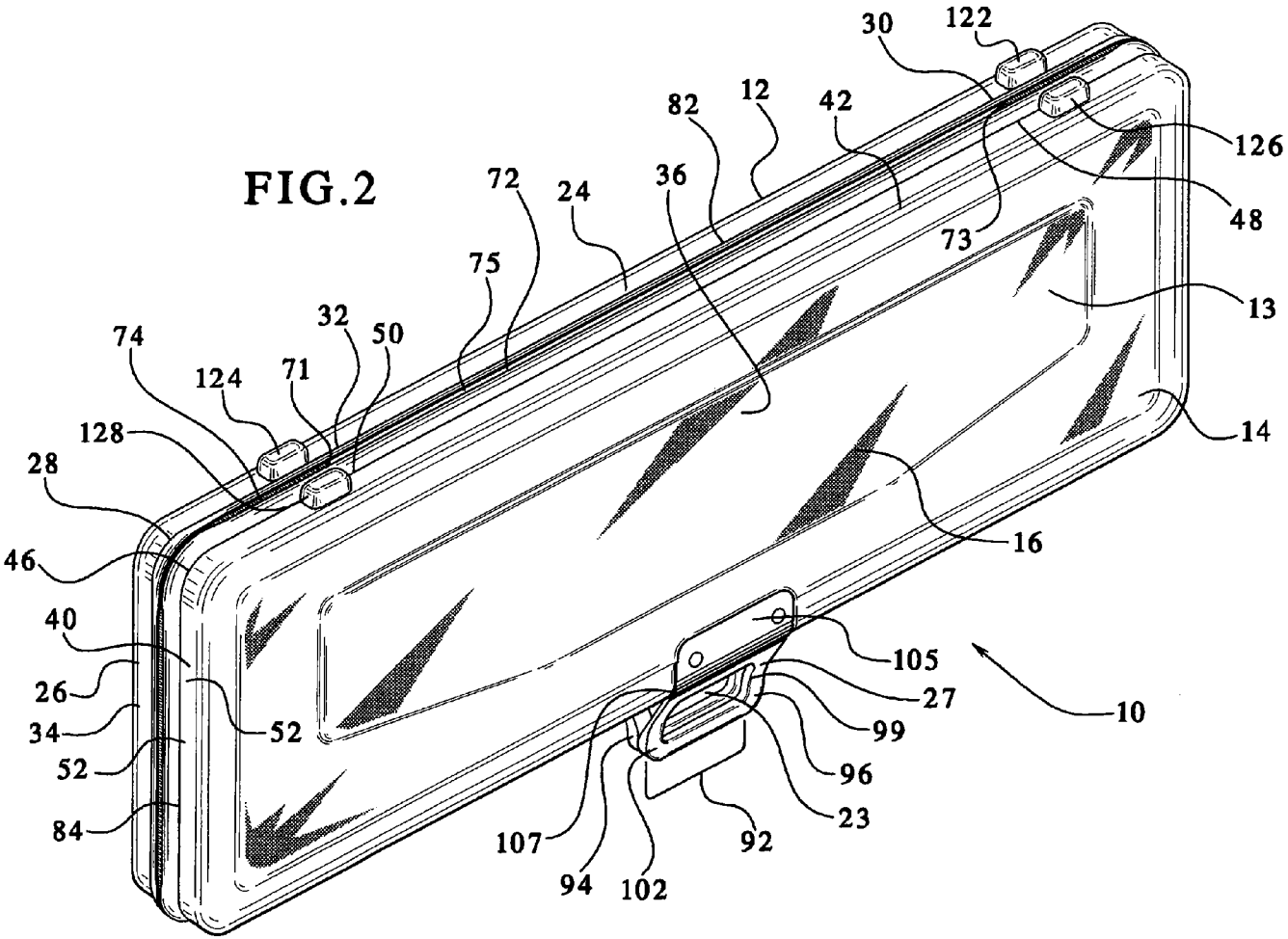
FIG. 2 is a rear, bottom perspective view of one embodiment of the weaponry container.

In one embodiment, as illustrated in FIGS. 1 to 6 the upper panel 12 includes a perimeter wall or edge 28 around a portion of the upper panel 12. In the illustrated embodiment, the perimeter or wall 12 extends the entire length of the upper panel 12. However, the edge 28 of the upper panel 12 may extend any suitable length of the upper panel 12. In one embodiment, the edge 28 includes a plurality of sections, portions or areas 30, 32 and 34. As best illustrated in FIG. 2, an upper panel area 30 connects to one end 71 of a coupler 72 (described below). The area 32 is adjacent to the end 73 of the coupler 72. The area 34 extends in-between the area 30 and the area 32.

Figure 8:
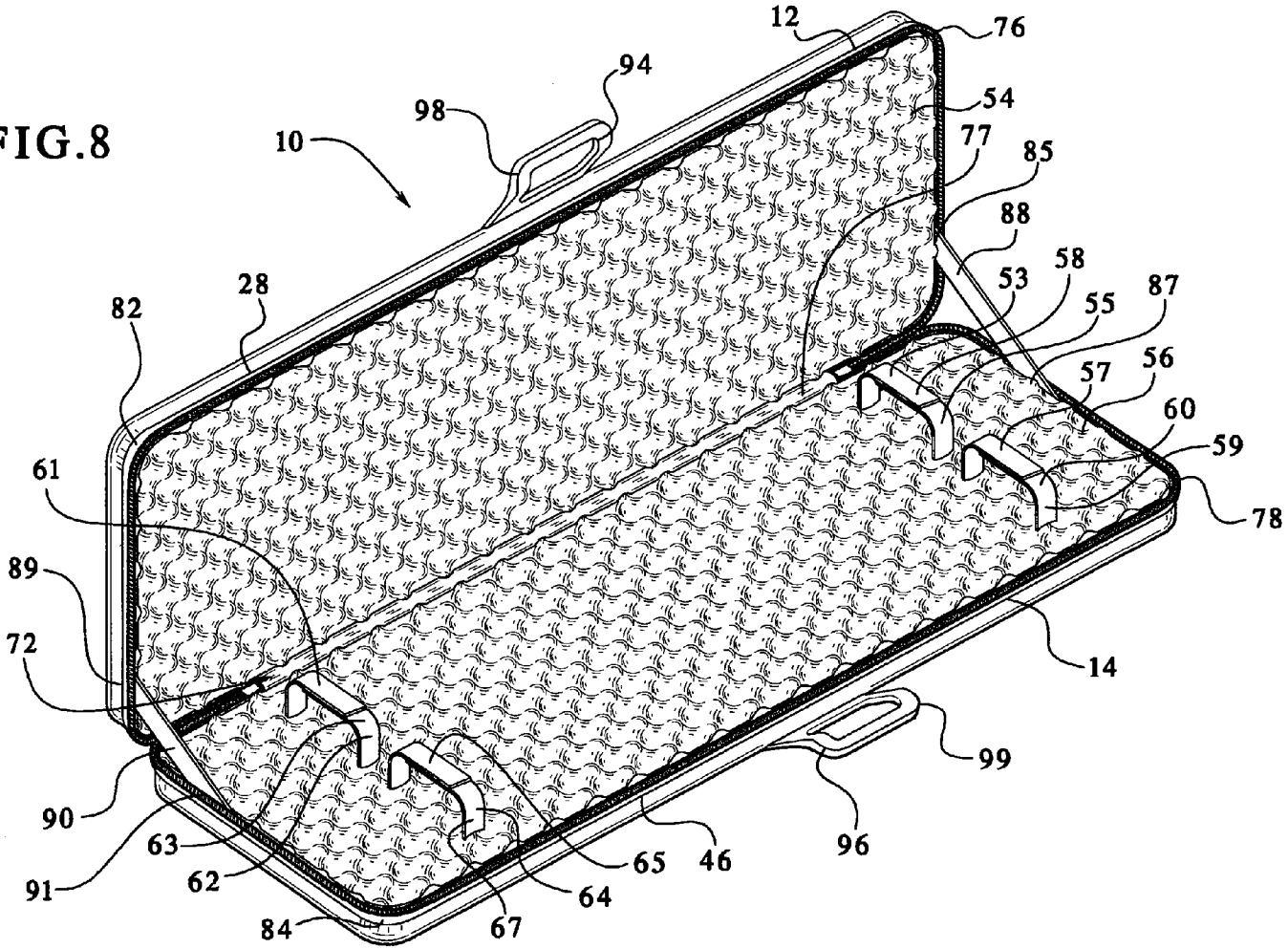
FIG. 8 is a perspective view of one embodiment of the weaponry container in an open position.

As illustrated in FIG. 8, an inner or interior portion of the upper panel 12 includes or supports a securing member 54 to generally secure the weapon and protect the weapon from damage. The securing member 54 may be a deformable insert, a biasing member or any other suitable device that decreases the movement or the shifting of the weapon held in the weaponry container 10. The securing member 54 may be attached to the upper panel 12 in any suitable manner. In one embodiment, the securing member 54 is glued to the interior of the upper panel 12 through the use of a suitable adhesive. The securing member 54 may be made out of any suitable material operable to reduce damage to the weapon caused by shock or impact to the weaponry container 10. In one embodiment, the securing member 54 is made out of a relatively light, porous, semi-rigid or spongy material such as foam.

In one embodiment, the upper panel 12 of the weaponry container 10 includes a handle securing mount or support to secure the handle 94 (described below) to the upper panel 12 of the weaponry container 10. In one embodiment, the handle securing mount of the upper panel 12 is the same as the handle securing mount 70 of the lower panel 14 illustrated in FIG. 9. It should be appreciated that, although the handle securing mount 70 is, in one embodiment, secured to the upper portion of the upper panel 12, the handle 94 may be secured to the upper panel 12 in any suitable manner.

In one embodiment, the upper panel 12 includes one or more name regions or name plate regions (not illustrated) defined by a recess or indentation. The name plate regions are operable to guide the placement and mounting of a name plate secured to that region of the weaponry container 10. It should be appreciated that the weaponry container 10 may include any suitable number of name plate regions and any suitable number of name plates.

As best illustrated in FIG. 2, the lower panel 14 includes the non-smooth surface 16, as described above. It should be appreciated, however, that the upper panel 12 and the lower panel 14 may include different surface characteristics. As illustrated in FIG. 2, the lower panel 14 includes a body 36. The body 36 may be any suitable shape. As best illustrated in FIGS. 1, 2, 4 and 5, in one embodiment, the lower panel 14 includes a plurality of sidewalls, retaining walls or side portions 38, 40, 42 and 44 extending from the body 36. In one embodiment, the sidewalls 38, 40, 42 and 44 are substantially perpendicular to the body 36. It should be appreciated that the lower panel 14 may include any suitable configurations of sections, sidewalls or portions that are operable to enclose one or more weapons.

Figure 5:
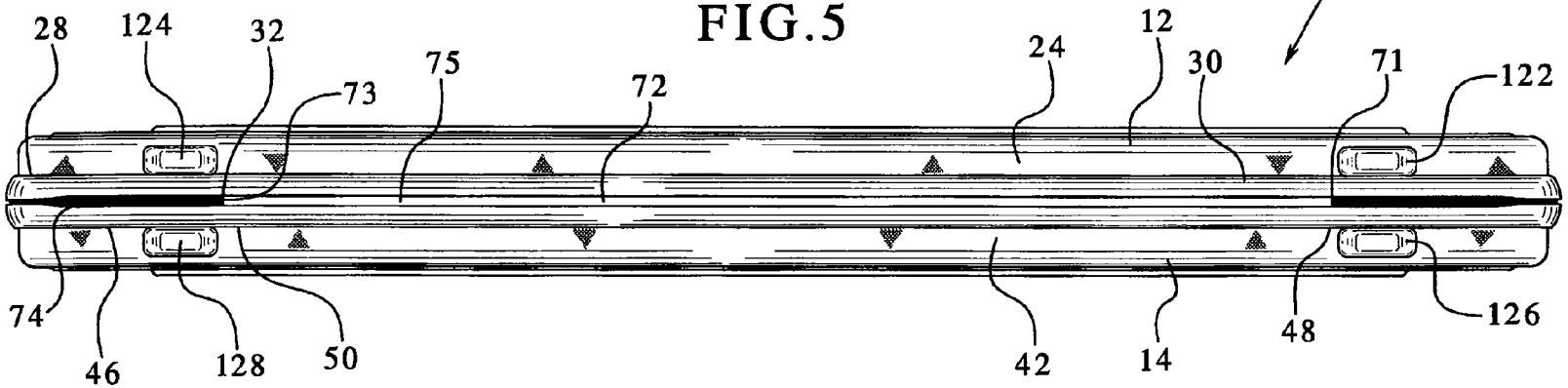
FIG. 5 is an elevated bottom view of one embodiment of the weaponry container.

In one embodiment, as illustrated in FIGS. 1, 2, and 4 to 6, the lower panel 14 includes an edge or a perimeter wall 46 around at least a portion of the lower panel 14. In the illustrated embodiment, the edge 46 extends the entire length of the lower panel 14. However, the edge 46 of the lower panel 14 may extend any length of the lower panel 14. As illustrated in FIG. 5, in one embodiment, the edge 46 includes a plurality of sections, portions or areas 48, 50 and 52. The area 48 is adjacent to one end 71 of a coupler 72 (described below). The area 50 connects to the other end 73 of the coupler 72. The area 52 extends in-between the area 48 and the area 50.

As illustrated in FIG. 8, an inner or interior portion of the lower panel 14 includes or supports a securing member 56 to generally secure the weapon and protect the weapon from damage. The securing member 56 may be a deformable insert, biasing member or other device that decreases the movement or the shifting of the weapon held in the weaponry container. The securing member 56 may be attached to the lower panel 14 in any suitable manner. In one embodiment, the securing member 56 is glued to the interior of the lower panel 14 through the use of a suitable adhesive. The securing member 56 may be made out of any suitable material operable to reduce damage to the weapon caused by shock or impact to the weaponry container 10. In one embodiment, the securing member 54 is made out of a relatively light, porous, semi-rigid or spongy material such as foam.

Figure 9:
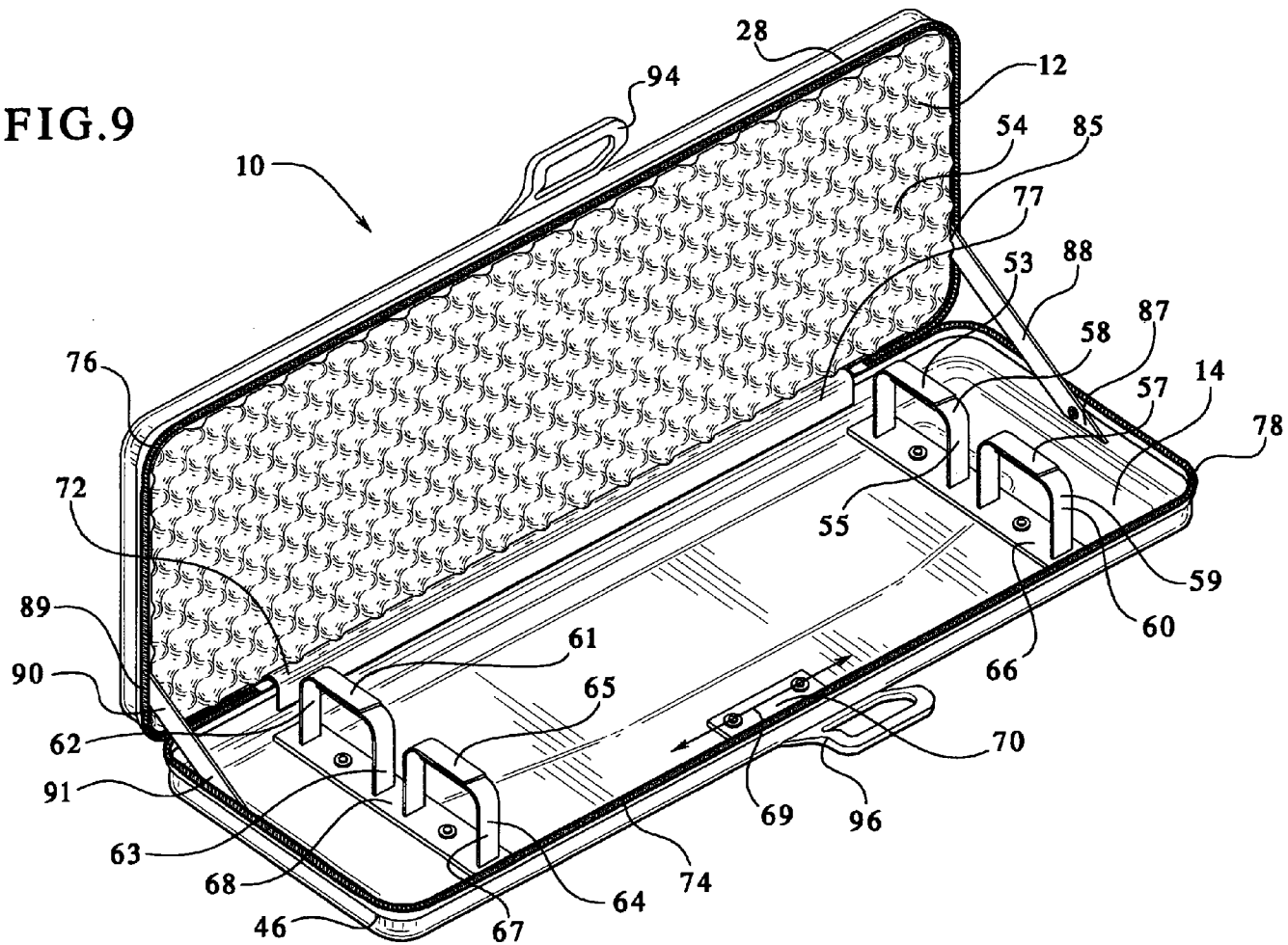
FIG. 9 is a perspective view of one embodiment of the panels of the weaponry container with the bottom panel weapon cushion removed.
Figure 10:
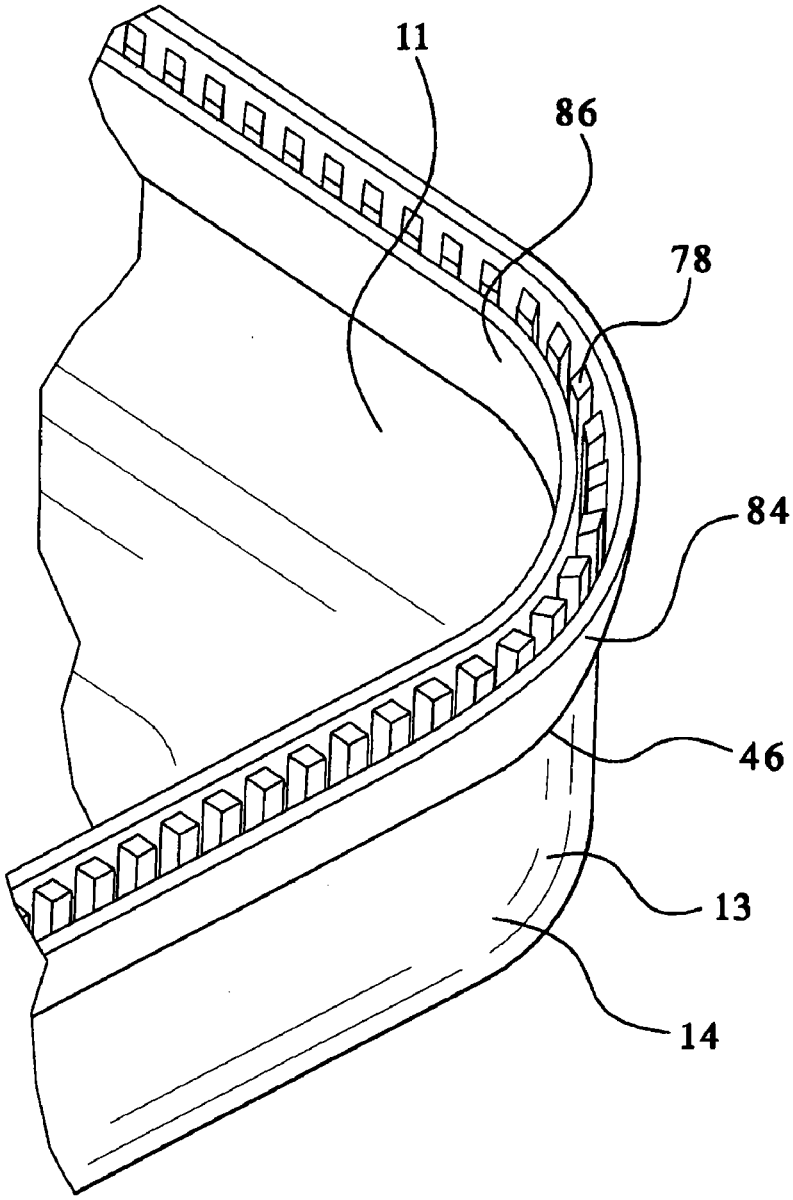
FIG. 10 is an enlarged view of one embodiment of a portion of the fastener, exterior lip and interior lip of one embodiment of the weaponry container.

As illustrated in FIG. 9, in one embodiment, the lower panel 14 of the weaponry container 10 includes a handle securing mount 70, to secure the handle 96 (described below) to the lower panel 14 of the weaponry container 10. It should be appreciated that though the handle securing mount 70 is, in one embodiment, secured to the upper portion of the lower panel 14, the handle securing mount 70 may be secured in any suitable manner. Additionally, the handle 94 may be secured to the lower panel 14 in any suitable manner.

In one embodiment, the lower panel 14 includes one or more name regions or name plate regions (not illustrated) defined by a recess or indentation. The name plate regions are operable to guide the placement and mounting of a name plate secured to that region of the weaponry container 10. It should be appreciated that the weaponry container 10 may include any suitable number of name plate regions and any suitable number of name plates.

As illustrated in FIGS. 8 and 9, the lower panel 14 of the weaponry container 10 includes one or more weapon holders 58, 60, 62 and 64. As illustrated in FIG. 9, a weapon holder mount or securing member 66 secures two of the weapon holders 58 and 60 to the lower panel 14. Another weapon holder mount or securing member 68 secures two of the weapon holders 62 and 64 to the lower panel 14. However, the weapon holders 58, 60, 62 and 64 may be secured to the lower panel 14 in any suitable alternative manner. The weapon holders 58, 60, 62 and 64 may be made out of any suitable material that has the strength to hold a weapon in place. In one embodiment, the weapon holders 58, 60, 62 and 64 are elastic, made of a relatively flexible stretchable fabric made with interwoven strands of rubber or synthetic fibers that are flexible enough to hold or secure many different sizes and types of weapons. The weapon holders 58, 60, 62 and 64 may be made out of the same materials or different materials. In one embodiment, each of the weapon holders 58, 60, 62 and 64 has a plurality of straps 53, 55, 57, 59, 61, 63, 65 and 67. In one embodiment, each strap 53, 55, 57, 59, 61, 63, 65 and 67 has a fastener, such as hooks and loops, enabling the loop size of the holder to be adjusted to fit the size of the gun part being held. However, it should be appreciated that the weapon holders 58, 60, 62 and 64 may be rigid.

In the illustrated embodiment, the weapon holders 58, 60, 62 and 64 are each substantially the same size and shape. However, the weaponry container 10 may be customized to hold any particular weapon and therefore may include any suitable number of weapon holders of different sizes and shapes. In one embodiment, certain weapon holders are used for certain portions of a weapon. For example, in one embodiment, one or more of the weapon holders 58 and 60 are rifle barrel holders and the other weapon holders 62 and 64 are rifle butt holders to hold a rifle in place. In another embodiment not shown, the weaponry container 10 is operable to hold or encase more than one weapon, and the panel 12 includes holders such as weapon holders 58, 60, 62 and 64 to hold a plurality of weapons. It should be appreciated that the weaponry container 10 may be operable to hold assembled or disassembled weapons.

As illustrated in FIG. 8, in one embodiment, the lower panel 14 of the weaponry container 10 includes a handle securing mount 70 to secure the handle 96 (described below) to the lower panel 14 of the weaponry container 10. It should be appreciated that, although the handle securing mount 70 is secured to the upper portion of the lower panel 14, the handle 96 may be secured to the lower panel 14 in any suitable alternative manner.

2. Coupler

The weaponry container 10 includes a securing member or coupler 72 such as a hinge, a connector, a joint, a bracket, a flexible arm, a strap or other securing member 72 connecting the panels 12 and 14 together. The coupler 72 enables the panels 12 and 14 to remain in a closed position as illustrated in FIGS. 1, 2, 3, 4, 5 and 6 and for the panels 12 and 14 to remain attached in a relatively open position as illustrated in FIGS. 8 and 9.

With reference to FIGS. 2, 5, 8 and 9, in one embodiment, the coupler 72 includes a plurality of sections or portions 75 and 77. In one embodiment, the coupler 72 includes an exterior coupler portion 75 and an interior coupler portion 77. In one embodiment, each of the coupler portions 75 and 77 are connected to both of the panels 12 and 14. For example, the exterior coupler portion 75 is attached to both the upper panel 12 and the lower panel 14. Additionally, the interior coupler portion 77 is attached to both the upper panel 12 and the lower panel 14.

In one embodiment, the coupler 72 covers a portion of the fastener 74. In such embodiment, the fastener 74 extends around the entire perimeter of each panel 12 and 14. Therefore, the coupler 72 covers the portion of the fastener between the ends 71 and 73 of the coupler. Here, the ends 71 and 73 of the exterior coupler portion 75 function as a stopper, blocking the sliding movement of the sliders 80 and 81 which are described below.

Each panel 12 and 14 includes an area 30 and 48, respectively, attached or adjacent to one of the ends 71 of the coupler 72, and another area 32 and 50, respectively, attached or adjacent to the other end 73 of the coupler 72. It should be appreciated that the coupler 72 may be attached to the weaponry container 10 in any suitable manner.

In one embodiment, each of the coupler portions 75 and 77 are removably attached to both of the panels 12 and 14, for example, through a hook and loop fastener. Therefore, the coupler portions 75 and 77 are each operable to be removed. In such embodiment, when a user removes the coupler 72 from the weaponry container 10, the user can entirely separate the panels 12 and 14 through the use of the fastener 74.

In another embodiment, the coupler 72 is a single flexible strap or belt strap that snaps or is bolted or riveted to each panel 12 and 14 and covers a portion of the fastener 74 of the weaponry case 10. In another embodiment, the coupler 72 is a hinge including any suitable parts, including without limitation, one or more hinges having two rigid plates pivotally joined along an axis.

The coupler 72 may be made out of any suitable material. In one embodiment, the coupler 72 is made out of rubber, leather, synthetic leather or any suitable polymer. In one embodiment, the coupler 72 is operable to guard a portion of the fastener 74 while helping to protect the weapon space 11 of the weaponry container 10 from liquids and debris.

In one embodiment, the weaponry container 10 includes a plurality of side couplers 88 and 90 which couple the panels 12 and 14 together. Here, each side coupler 88 and 90 includes a strap having a flexible characteristic, and a designated length and width. The ends 85, 87, 89 and 91 of each side coupler 88 and 90 are sewn to the panels 12 and 14. The length of each side coupler 88 and 90 function as an opening limiter which limits the opening of the weaponry container 10 to a designated angle.

3. Fastener

Figure 11:
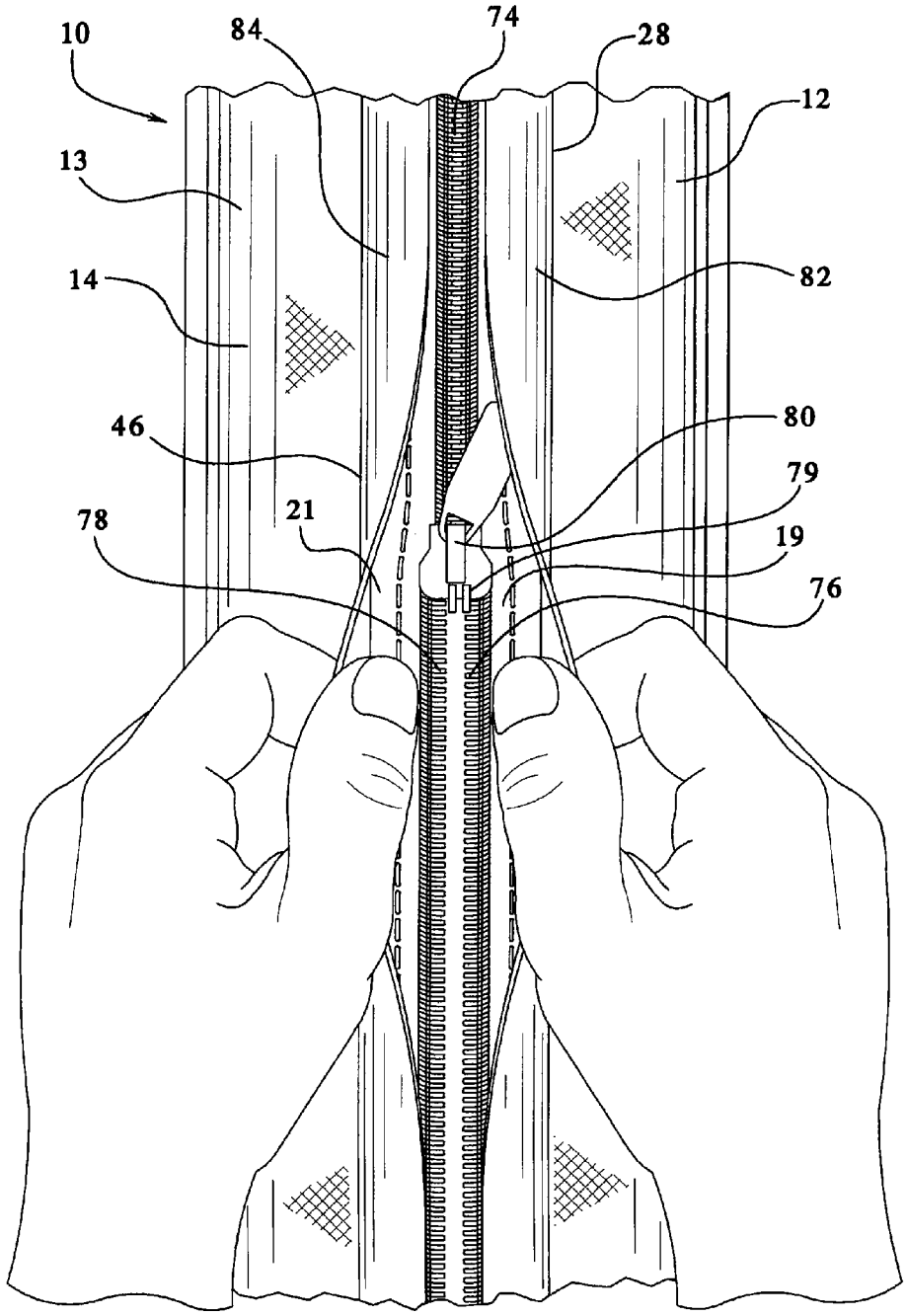
FIG. 11 a top perspective view of one embodiment of the fastener, exterior lips and sidewalls of the weaponry container.
Figure 12:
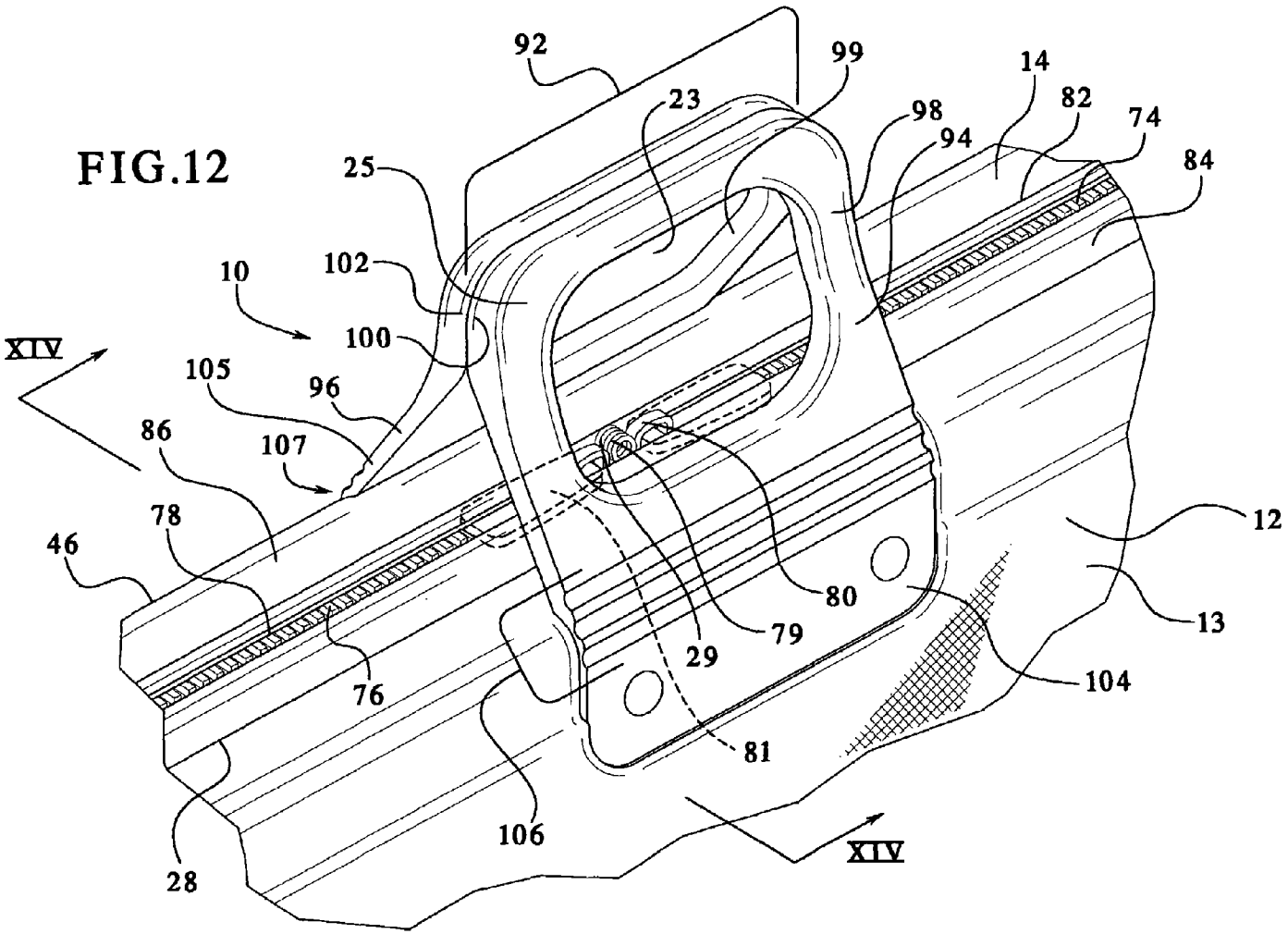
FIG. 12 is an enlarged perspective view of the handle assembly of one embodiment of the weaponry container in a closed position.

The panels 12 and 14 are operable to be interchanged between open and closed positions by an elongated securing device or fastener 74 best illustrated in FIG. 11. In the illustrated embodiment, the fastener 74 includes a zipper having fastener couplers 19 and 21 which support a fastening mechanism, such as a plurality of rows of teeth 76 and 78, respectively. Each of the rows of teeth 76 and 78 is attached to an edge 28 and 46, respectively, of the upper panel 12 and the lower panel 14. In one embodiment, the rows of teeth 76 and 78 extend the entire edge 28 and 46 of each panel 12 and 14. That is, the fastener 74 extends the entire perimeter of the weaponry container 10. In one embodiment, as illustrated in FIGS. 11 and 12, the fastener couplers 19 and 21 secure the rows of teeth 76 and 78, respectively, to the panels 12 and 14, respectively, of the weaponry container 10. In the illustrated embodiment, the fastener couplers 19 and 21 are sewn onto the weaponry container 10. However, the fastener couplers 19 and 21 may be attached to the weaponry container 10 in any suitable manner. In the illustrated embodiment, the fastener 74 has a plurality of slidable members or sliders 80 and 81. Sliders 80 and 81 are operable to interchangeably interlock the rows of teeth 76 and 78. Accordingly, the sliders 80 and 81 of the fastener 74 are attached a portion of each of the rows of teeth 76 and 78 and are operable to fasten the panels 12 and 14 together in a closed position, as illustrated in FIGS. 1, 2, 3, 4, 5 and 6. It should be appreciated that the fastener 74 may include only one of the sliders 80 and 81. In the illustrated embodiment, each of the sliders 80 and 81 include a lock receiver 79 and 29. As illustrated in FIG. 12, when the sliders 80 and 81 are in an adjacent position, the lock receivers 79 and 29 interlock to create a position for a lock to be inserted to secure the sliders 80 and 81 in an adjacent position, therefore, securing the weaponry container 10 in a closed position.

In one embodiment, as described above, the fastener 74 extends around the entire perimeter of the weaponry container 10. In such embodiment, the fastener 74 enables the panels 12 and 14 to be interchangeably separated and uncoupled from one another.

It should be appreciated that the fastener 74 may be any suitable fastener or securing device, including, but not limited to: one or more slide fasteners; buttons; hook and loop fasteners, such as fasteners sold under the trademark VELCRO™; threads or other sewing materials; slide devices; devices having a series of snaps; devices having a series of buckles, hooks or loops; fixed or detachable clasps; and suitable modifications and combinations thereof. It should also be appreciated that the fasteners or the securing devices 74 of the weaponry container 10 may be made of any suitable material.

4. Lip

In one embodiment, the weaponry container 10 includes one or more elongated covers, guards, overhangs, flaps, flanges, extensions or lips 82 and 84. Lips 82 and 84, which have a flexible characteristic, extend along one or more sections of the edges 28 and 46, respectively, of one or more of the panels 12 and 14, respectively. In the embodiment illustrated in FIGS. 11 and 14, the weaponry container 10 includes an exterior upper lip 82 attached to a portion of the edge 28 of the upper panel 12. The weaponry container 10 includes an exterior lower lip 84 attached to a portion of the edge 46 of the lower panel 14. In this illustrated embodiment, each of the lips 82 and 84 covers at least a portion of the fastener couplers 19 and 21, respectively. Specifically, the upper lip 82 covers part of the fastener coupler 19. The lower lip 84 covers part of the fastener coupler 21. It should be appreciated that the lips 82 and 84 may be constructed as one integral piece although they are illustrated as separate, connected components. In one embodiment not illustrated, one or more of the lips 82 and 84 covers a substantial part of all of the rows of teeth 76 and 78.

Lips 82 and 84 surround and house part or all of the fastener couplers 19 and 21 to reduce the likelihood that liquid and fluid can penetrate the fastener couplers 19 and 21 and leak into the weaponry container 10. The lips 82 and 84 may be made out of any suitable material. In one embodiment, the lips 82 and 84 are made out of a weather and liquid resistant material such as rubber, plastic or any suitable polymer-based material.

Figure 14:
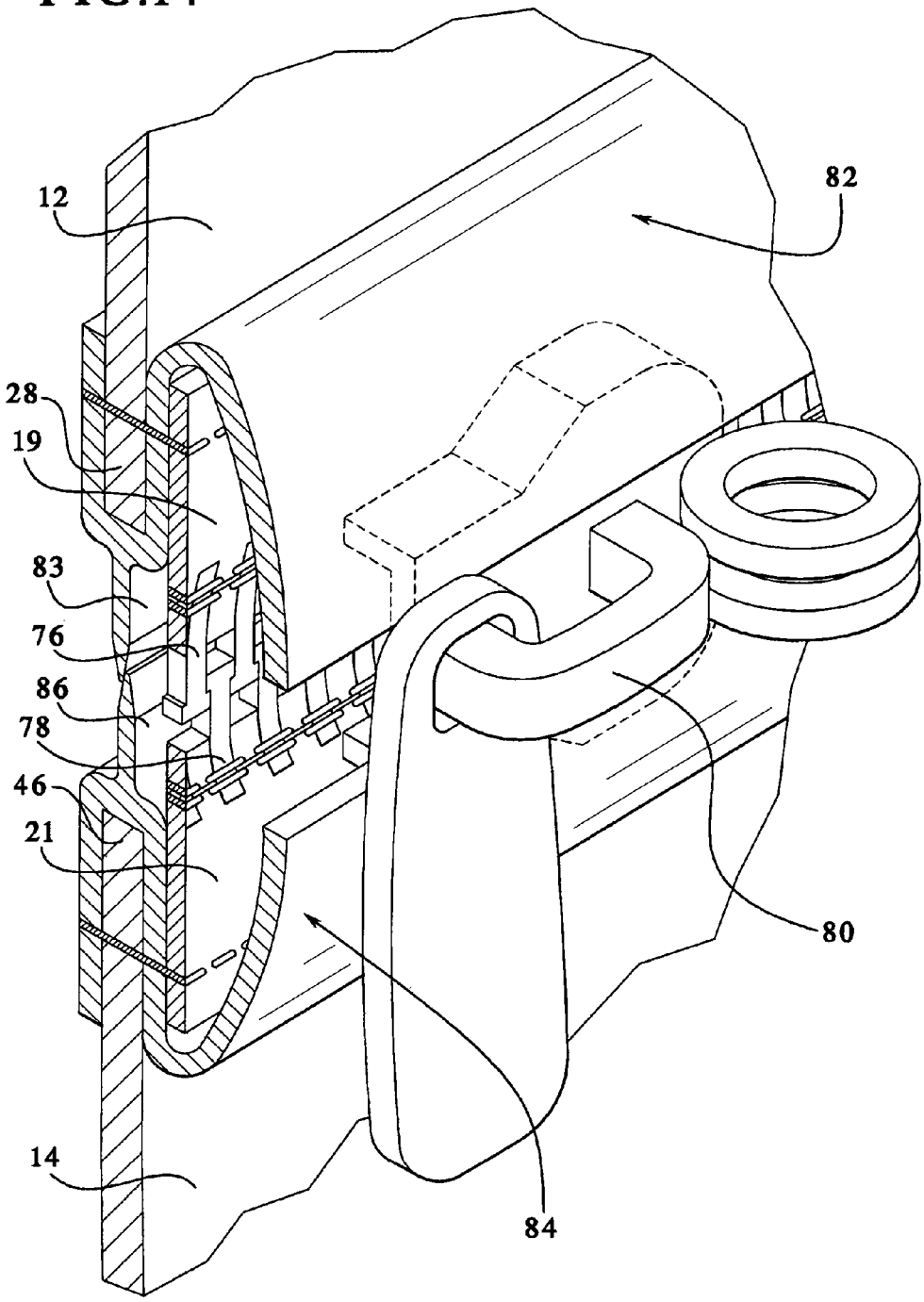
FIG. 14 is a cross-sectional and perspective enlarged view of one embodiment of the weaponry container in a closed position taken substantially along line XIV of FIG. 12.

In one embodiment, as illustrated in FIG. 14, the lips 82 and 84 are directly attached to the panels 12 and 14, and the fastener 74 is attached to one or more of the lips 82 and 84. Therefore, the lips 82 and 84 connect the fastener 74 to the panels 12 and 14.

Referring to FIG. 14, in one embodiment, lip 82 includes an interior portion 83, and lip 84 includes an interior portion 86. Interior lip 83 is substantially parallel to the exterior lip 82, and the interior lip 86 is substantially parallel to the exterior lip 84. Here, lip 82 and lip 84 each define an s-shaped configuration surrounding the fastener couplers 19 and 21, respectively. In one embodiment, the interior lip portions 83 and 86 are integral with the lips 82 and 84, respectively. When the fastener 74 of the weaponry container 10 is in the closed position, the interior lip portions 83 and 86 provide further protection against liquids or other materials entering the weaponry container 10. That is, the interior lip portions 83 and 86 are in contact with one another, such as in an overlap interface, when the weaponry container 10 is in a closed position. When the weaponry container 10 is in a closed position, the interior lip portions 83 and 86 substantially meet or overlap to create a barrier to reduce the likelihood that outside materials could penetrate the lips 82 and 84 enter the weaponry container 10. It should be appreciated that the weaponry container 10 can alternatively include a single interior lip portion only attached to one of the panels 12 and 14. It should also be appreciated that the interior lip portions 83 and 86 do not have to meet or overlap to provide when the weaponry container 10 is in a closed position.

5. Handle Assembly

Referring to FIG. 12, the handle assembly 92 may include one or more suitable grips, handles, straps or any other device operable to enable a user to lift, pull or drag the weaponry case 10. In one embodiment, the handle assembly 92 includes two handles: an upper panel handle 94 and a lower panel handle 96. In one such embodiment, the upper panel handle 94 and the lower panel handle 96 have the same shape and size but are attached to different panels 12 and 14 of the weaponry container 10.

As illustrated in FIGS. 2 and 12, the handles 94 and 96 include handle walls 98 and 99, respectively, which define holes or openings 23 that is sized to receive at least a portion of a hand. In one embodiment, the opening 23 is a substantially rectangular hole with rounded corners. It should be appreciated that the handle walls 98 and 99 can be configured to define a hole or an opening of any suitable shape or size.

As illustrated in FIGS. 6 and 12, the handles 94 and 96 include mating regions 100 and 102. The mating regions 100 and 102 are operable to fit against or engage with each other so that the exterior surfaces 23 and 25 of the handles 94 and 96, respectively, adopt a shape associated with the interior of a singled closed hand, which provides an enhanced ergonomic function of one embodiment of the hand assembly 92. As illustrated in FIG. 12, the upper handle 94 includes a mating region 100, that when the weaponry container 10 is in a closed position, abuts or lies adjacent to the mating region 102 of the lower handle 96. The mating regions 100 and 102 may include any parts or members of a suitable shape and size. For example, such mating regions may have members including a male member, a female member, a substantially flat member, a concave member or a convex member.

In one embodiment, the handles 94 and 96 include securing portions or legs 104 and 105, respectively, for securing the handles 94 and 96 to the respective panel 12 and 14. As illustrated in FIG. 12, the upper handle leg 104 includes a region for attaching the upper handle 94 to the upper panel 12. The lower handle leg 105 includes a region for attaching the lower handle 96 to the upper panel 14. As shown, the handle 94 may be bolted or riveted to the panel 12 in the handle leg 104. However, it should be appreciated that the handles 94 and 96 may be attached to the weaponry container 10 in any suitable fashion.

In one embodiment, the handles 94 and 96 include a handle securing mount 70 attached to the interior of the panel as illustrated in FIG. 10. In one embodiment, this handle securing mount 70 distributes the force exerted on the handle on a longitudinal axis 69 as illustrated in FIG. 9.

In one embodiment, the legs 104 of the handles 94 and 96 include flexible strips, ribs or flexible zones 106 and 107, respectively, that enable the handle 94 and 96 to be substantially movable or flexible. In the illustrated embodiment, such flexible zones 106 and 107 are horizontal strips of different widths of material enabling the handles 94 and 96 to bend at different angles. The handles 94 and 96 may be flexible in any suitable way.

Figure 13:
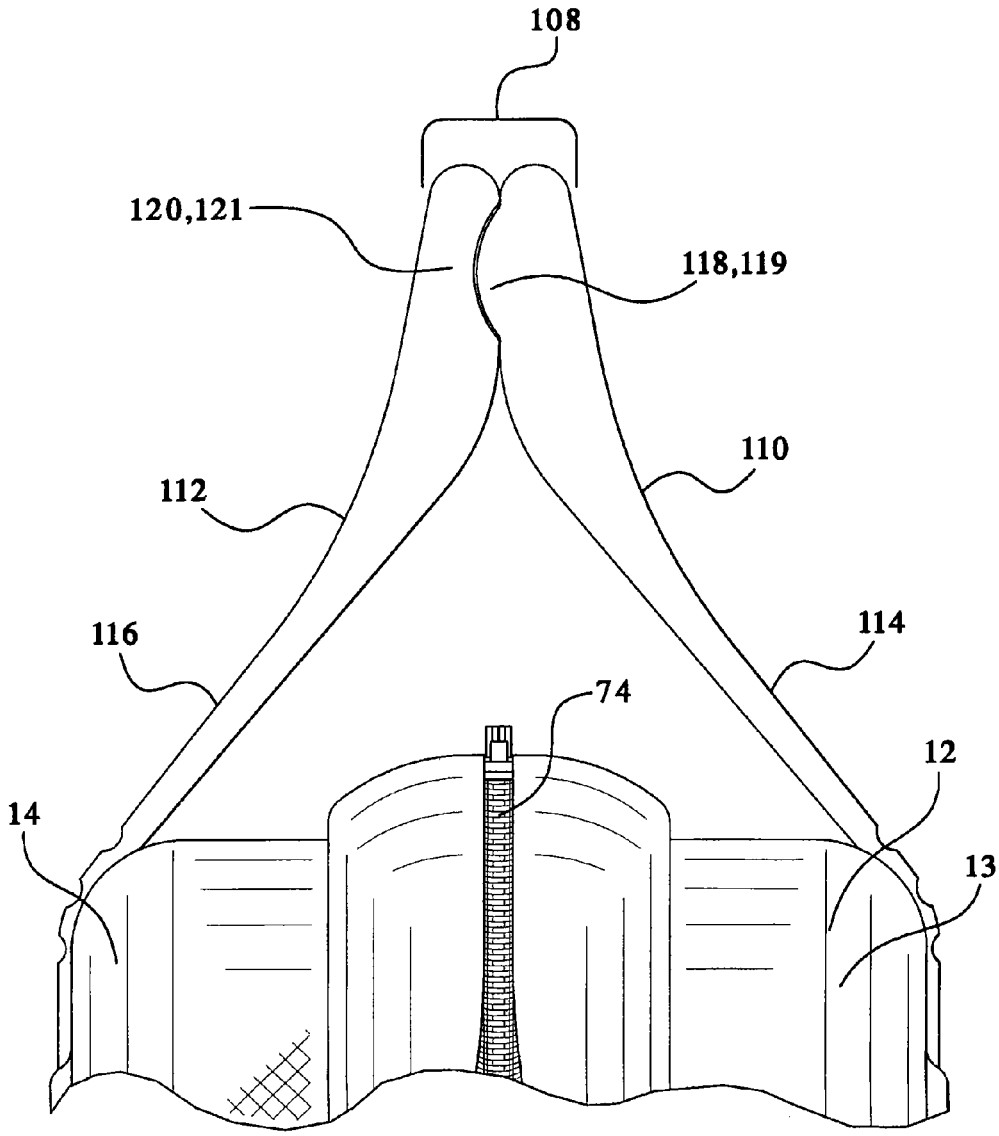
FIG. 13 is an elevated end or side view of one embodiment of the handle assembly of the weaponry container.

In one embodiment illustrated in FIG. 13, the handle assembly 108 includes handles 110 and 112. The mating region 118 of handle 110 includes a male member 119 and the mating region 120 of the handle 112 includes a female member 121. The male member 119 co-acts with the female member 121 so that the handle 108 fits in a closed hand space.

6. Feet

In one embodiment, the weaponry container 10 includes one or more legs, supports or feet 122, 124, 126 and 128, as illustrated in FIGS. 1, 2, 3, 5 and 6. Specifically the upper panel 12 includes a plurality feet 122 and 124 each aligned next to one of the coupler ends 71 and 73 on the bottom sidewall 24. The lower panel 14 includes a plurality feet 126 and 128 each aligned next to one of the coupler ends 71 and 73 on the bottom sidewall 42. The feet 122, 124, 126 and 128 help protect the weaponry container 10 from scraping and wear and tear by distancing the bottom sidewalls 24 and 42 from the ground or support surface. Also, the feet 122, 124, 126 and 128 increase the stability of container 10 when is positioned in upright position illustrated in FIG. 6.

The feet 122, 124, 126 and 128 of the weaponry container 10 may be made out of any suitable material that is capable of supporting the weight of the weaponry container 10 including at least one weapon inside the weaponry container 10. It should be appreciated that the weaponry container 10 may include any number of legs or feet 122, 124, 126 and 128 that enable a user of the weaponry container 10 to balance the case substantially upright.

7. Other Elements

It should be appreciated that the weaponry case 10 of the present disclosure may include any combination of elements. In one embodiment, both the upper panel 12 and the lower panel 14 include one or more weapon holders 58, 60, 62 and 64. In another embodiment, only one of the panels 12 and 14 includes one or more weapon holders 58, 60, 62 and 64. It should be appreciated that either panel 12 and 14 may include any suitable number of weapon holders 58, 60, 62 and 64.

In one embodiment, the weaponry container 10 includes one or more locks or security devices. The lock or security device may be any suitable device, including, but not limited to, a key lock or a pad lock attachable to the lock receivers 79 and 29 of the fastener 74. In one embodiment, the lock is operable to secure the fastener 74 in a closed and locked position. The lock may be separate from the weaponry container 10 or integrated into the weaponry container 10.

In one embodiment, the weaponry container 10 includes at least one pressure release valve. In one embodiment, this pressure release valve is designed or set to open at a predetermined pressure to protect the weapon from being subject to excess pressures which may occur, for example, when weaponry container 10 is flown in an air plane at a relatively high altitude.

In another embodiment, the weaponry container 10 includes one or more wheels. The wheels enable the user of the weaponry container 10 to move the weaponry container 10 without having to carry the weaponry container 10. In one such embodiment, the wheels are retractable. In one embodiment, the weaponry container 10 includes one or more handles or tow handles to pull the weaponry container 10. In one such embodiment, the handles 94 and 94 or the handle assembly 92 is retractable into the interior of the weaponry container 10.

It should be appreciated that the weaponry container 10 may include any suitable number of pockets, pouches, holders, subsections, attachments, bags, cavities, chambers or other compartments. In one embodiment, such compartments are used to store ammunition. In other embodiments, such compartments are used to store identifying information and other supplies.

It should also be appreciated that the above-described components and structure of the weaponry container 10 can be included within any suitable alternate container or case, including, but not limited to: a sport equipment case or container or a sporting good case or container configured to hold sports equipment or athletic equipment; a music instrument case or container configured to hold musical instruments or equipment; a utility case or container configured to hold carpentry equipment, plumbing equipment, electrical equipment or other utility-related tools; and travel luggage.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A weaponry container comprising:

a plurality of elongated walls movably coupled to one another, each one of the walls having:

(a) a length extending along a longitudinal axis, (b) a width extending along a lateral axis, the lateral axis intersecting with the longitudinal axis, (c) a perimeter, (d) an outer surface, at least part of the outer surface having a rigid characteristic, and (e) an inner surface, the elongated walls defining an inner space when the weaponry container is closed, the inner space being configured to receive a first elongated weapon and a second elongated weapon;

at least one fastener coupled to at least one of the elongated walls;

a first weaponry holder coupled to the inner surface of a first one of the elongated walls, the first weaponry holder being flexible, the first weaponry holder having a plurality of sections, the sections being spaced apart from each other along an axis parallel to the lateral axis, each one of the sections extending from the inner surface, each one of the sections having a section end, at least one of the section ends having a first fastener configured to removably attach the section ends to each other, the sections defining a first holding space when the section ends are attached to each other, the first holding space having a size, the first fastener enabling adjustment of the size so that, when an end of the first elongated weapon is inserted into the first holding space:

(a) said sections restrain a lateral movement of said end along the first axis; and (b) the first weaponry holder secures said end to the first elongated wall;

a second weaponry holder coupled to the inner surface of the first elongated wall, the second weaponry holder being flexible, the second weaponry holder having a plurality of sections, the sections being spaced apart from each other along the axis parallel to the lateral axis, each one of the sections extending from the inner surface, each one of the sections having a section end, at least one of the section ends having a second fastener configured to removably attach the section ends to each other, the sections defining a second holding space when the section ends are attached to each other, the second holding space having a size, the second fastener enabling adjustment of the size so that, when an end of the second elongated weapon end is inserted into the second holding space:

(a) said sections restrain a lateral movement of said end along a second axis; and (b) the second weaponry holder secures said end to the first elongated wall; and a flexible extension coupled to at least one of the walls, part of the flexible extension extending adjacent to at least a portion of the perimeters of the walls when the weaponry container is closed.

2. The weaponry container of claim 1, wherein each one of the elongated walls has a wall portion and a sidewall portion extending from the elongated wall portion, the wall portion and the sidewall portion each having a rigid outer surface.

3. The weaponry container of claim 1, wherein the outer surface has a first grid of raised rounded portions defining a second grid of spaces, the first grid associated with a level of scratch resistance for the walls.

4. The weaponry container of claim 1, wherein the outer surface has a strength sufficient to avoid a collapse of either one the elongated walls when said wall is subject to a weight of the elongated weapons supported by said wall.

5. The weaponry container of claim 1, wherein the extension is integral with at least one of the elongated walls.

6. The weaponry container of claim 1, wherein the fastener includes a device selected from the group consisting of an edgewise coupler having a slide device, a resealable fastener, a zipper, a device having a plurality of hooks and loops, a device having a plurality of snaps and a device having a plurality of buckles.

7. The weaponry container of claim 1, wherein the fastener includes: (a) a plurality of rows of teeth adjacent; and (b) a slider coupled to the teeth.

8. The weaponry container of claim 1, which includes a handle assembly, the handle assembly having a plurality of handles, each one of the handles having a handle mating surface.

9. The weaponry container of claim 1, wherein: (a) the fastener has a plurality of portions including a fastening mechanism and a fastener coupler which secures the fastening mechanism to the wall; and (b) the extension has a flexible characteristic, the extension being movable between:

(i) a first position in which the extension is predisposed to cover at least one of the portions of the fastener; and (ii) a second position in which the extension is movable to uncover said portion of the fastener.

10. The weaponry container of claim 1, wherein at least one weaponry holder includes a holder selected from the group consisting of a rifle holder, a shotgun holder, an assault weapon holder, an air pressured gun holder, a bow holder, an arrow holder, a crossbow holder and a paintball gun holder.

11. A weaponry container comprising:

a plurality of elongated connected panels, the panels movable so as to define an open position and a closed position, each one of the panels having:

(a) a rigid outer surface, (b) a length extending along a longitudinal axis, (c) a width extending along a lateral axis, the lateral axis intersecting with the longitudinal axis, (d) an inner surface, the elongated panels defining an inner space when the weaponry container is closed, the inner space being configured to receive a rifle, the rifle having a rifle barrel and a rifle butt, and (e) a perimeter;

a first holder coupled to the inner surface of a first one of the elongated panels; the first holder being flexible, the first holder having a plurality of sections, the sections being spaced apart from each other along a first axis parallel to the lateral axis, each one of the sections extending from the inner surface, each one of the sections having a section end, at least one of the section ends having a first fastener configured to removably attach the section ends to each other, the sections defining a first holding space when the section ends are attached to each other, the first holding space having a size, the first fastener enabling adjustment of the size so that, when the rifle barrel is inserted into the first holding space:

(a) said sections restrain a lateral movement of the rifle barrel along the first axis; and (b) the first holder secures the rifle barrel to the first elongated panel;

a second holder coupled to the inner surface of the first elongated panel, the second holder being located apart from the first holder on a second axis, the second axis being parallel to the longitudinal axis, the second axis extending through the first and second holders, the second holder being flexible, the second holder having a plurality of sections, the sections being spaced apart from each other along a third axis parallel to the lateral axis, each one of the sections extending from the inner surface, each one of the sections having a section end, at least one of the section ends having a second fastener configured to removably attach the section ends to each other, the sections defining a second holding space when the section ends are attached to each other, the second holding space having a size, the second fastener enabling adjustment of the size so that, when the rifle butt is inserted into the second holding space:

(a) said sections restrain a lateral movement of the rifle butt along the third axis; and (b) the second holder secures the rifle butt to the first elongated panel;

at least one fastener connected to at least a portion of the perimeter of each of the panels, the fastener having a plurality of parts having:

(a) at least one coupler part operable to couple the fastener to the portions of the perimeters of the elongated panels, and (b) at least one slider part operable to connect the portions of the perimeters of the elongated panels together when the panels are in the closed position; and a cover having:

(a) one cover portion connected to the portion of the perimeter of one of the elongated panels; and (b) another cover portion connected to the portion of the perimeter of the other elongated panel, the cover portions configured to:

(i) cover at least one of the parts of the fastener; and (ii) resist entrance of liquid into the weapon space when the portions of the perimeters of the elongated panels are connected together by the fastener.

12. The weaponry container of claim 11, wherein: (a) the rifle includes a weapon selected from the group consisting of a shotgun and an elongated gun; and (b) the fastener includes a device selected from the group consisting of a resealable fastener, a device having a plurality of rows of teeth configured to be interlocked by the slider and a zipper.

13. The weaponry container of claim 11, which includes a handle assembly, the handle assembly having a plurality of handles, each one of the handles having a handle mating surface.

14. The weaponry container of claim 11, wherein the rigid outer surface has a first grid of raised rounded portions defining a second grid of spaces, the first grid associated with a level of scratch resistance for the panels.

15. The weaponry container of claim 11, which includes: (a) a coupler which hingedly connects the panels together; and (b) another cover covering at least part of the coupler, the cover configured to resist entrance of liquid into the space.

16. The weaponry container of claim 11, which includes a plurality of feet which extend beyond the coupler.

17. The weaponry container of claim 11, wherein at least one holder includes a holder selected from the group consisting of a rifle holder, a shotgun holder, an assault weapon holder, an air pressured gun holder, a bow holder, an arrow holder, a crossbow holder and a paintball gun holder.

18. A weaponry container comprising:

a plurality of elongated connected panels, each one of the elongated panels having:

(a) a length extending along a longitudinal axis, (b) a width extending along a lateral axis, the lateral axis intersecting with the longitudinal axis, (c) a rigid outer surface, and (d) an inner surface, the elongated panels defining an inner space when the weaponry container is closed, the inner space being configured to receive an elongated weapon, the elongated weapon having first and second weapon ends;

at least one zipper coupled to the elongated panels, the zipper operable to position the connected panels in a closed position;

first weaponry holder coupled to the inner surface of a first one of the elongated panels, the first weaponry holder being flexible, the first weaponry holder having a plurality of sections, the sections being spaced apart from each other along a first axis parallel to the lateral axis, each one of the sections extending from the inner surface, each one of the sections having a section end, at least one of the section ends having a first fastener configured to removably attach the section ends to each other, the sections defining a first holding space when the section ends are attached to each other, the first holding space having a size, the first fastener enabling adjustment of the size so that, when the first weapon end is inserted into the first holding space:

(a) said sections restrain a lateral movement of the first weapon end along the first axis; and (b) the first weaponry holder secures the first weapon end to the first elongated panel;

a second weaponry holder coupled to the inner surface of the first elongated panel, the second weaponry holder being located apart from the first weaponry holder on a second axis, the second axis being parallel with the longitudinal axis, the second weaponry holder being flexible, the second weaponry holder having a plurality of sections, the sections being spaced apart from each other along a third axis parallel to the lateral axis, each one of the sections extending from the inner surface, each one of the sections having a section end, at least one of the section ends having a second fastener configured to removably attach the section ends to each other, the sections defining a second holding space when the section ends are attached to each other, the second holding space having a size, the second fastener enabling adjustment of the size so that, when the second weapon end is inserted into the second holding space:

(a) said sections restrain a lateral movement of the second weapon end along the third axis; and (b) the second weaponry holder secures the second weapon end to the first elongated panel;

at least one weaponry securing member coupled to the inner surface of at least one of the panels, the weaponry securing member having: (a) a deformable characteristic; and (b) a biasing characteristic, the weaponry securing member configured to apply a biasing force to the elongated weapon and reduce shock to the elongated weapon when the elongated weapon is inside the weaponry container during movement of the weaponry container;

handle assembly, including first and second handles, the first handle having:

(a) a leg connected to the first elongated panel;

(b) a wall defining an opening sized to receive at least part of a hand, and (c) an end having a handle mating region, the second handle having:

(a) a leg connected to the second elongated panel;

(b) a wall defining an opening sized to receive at least part of the hand, and (c) a first end having a handle mating region, the handle mating regions of the first and second handles configured to mate with each other when the ends of the first and second handles are in contact with each other.

19. The weaponry container of claim 18, wherein each one of the handle mating regions has a member selected from the group consisting of a male member, a female member, a substantially flat member, a concave member and a convex member.

20. The weaponry container of claim 18, wherein the fastener includes a device selected from the group consisting of a resealable fastener, a device having a plurality of rows of teeth, a device having a slider and a zipper.

21. The weaponry container of claim 18, wherein the rigid outer surface has a first grid of raised rounded portions defining a second grid of spaces, the first grid associated with a level of scratch resistance for the elongated panels.

22. The weaponry container of claim 18, which includes a plurality of feet which extend beyond the coupler.

23. The weaponry container of claim 18, wherein the rigid outer surface has a strength sufficient to avoid a collapse of either one of the elongated panels when said panel is subject to a weight of a weapon supported by said panel.

24. The weaponry container of claim 18, wherein the deformable characteristic has a spongy characteristic.

25. The weaponry container of claim 24, wherein at least one weaponry holder includes at least one flexible strap.

26. The weaponry container of claim 24, wherein at least one weaponry holder includes a plurality of flexible straps, each one of the straps having a fastener, each fastener being configured to detachably connect to at least one of the other fasteners.

* * * * *